US005731532A

United States Patent [19]

Slaby

[11] Patent Number: 5,731,532

[45] Date of Patent: Mar. 24, 1998

[54] ACCORDION SLIDING BASS

[76] Inventor: Joseph J. Slaby, 5817 S. Kilbourn, Chicago, Ill. 60629

[21] Appl. No.: 644,946

[22] Filed: May 13, 1996

[51] Int. Cl.[6] ..... G10D 11/00

[52] U.S. Cl. ..... 84/376 A; 224/910; 224/219; 224/250

[58] Field of Search ..... 84/376 A, 376 SM; 224/910, 218, 219, 250

[56] References Cited

U.S. PATENT DOCUMENTS 2,134,854 11/1938 Bolster .
2,187,809 1/1940 Rabuazzo .
2,930,274 3/1960 Renna ..... 84/376 A
3,776,089 12/1973 Cohen .
4,159,664 7/1979 Mastronardi .
4,226,161 10/1980 Goetsch .
4,884,488 12/1989 Curletto .
5,099,737 3/1992 Curletto .

*Primary Examiner*—Cassandra C. Spyrou
*Attorney, Agent, or Firm*—McDonnell Boehnen Hulbert & Berghoff

[57] ABSTRACT

A sliding bass mechanism is disclosed and creates an excellent environment for the left wrist, hand and fingers to manipulate the bass and chord buttons of an accordion. This sliding bass makes possible the delivery of accurate rhythmic and harmonious pulse. The accordion sliding bass of this invention presents an opportunity to allow the left wrist, hand and fingers the freedom to reach a new degree of speed, accuracy and force, while at the same time being able to push and pull the accordion in a very smooth manner.

1 Claim, 2 Drawing Sheets

ACCORDION SLIDING BASS

FIELD OF THE INVENTION

This invention relates to the bass section of the accordion, specifically the left hand control and manipulation of the bass and chord buttons.

BACKGROUND AND DESCRIPTION OF THE PRIOR ART

All accordions of the accordion family have one thing in common. They all have three fundamental sections. The first section on the right side of the accordion is called the treble side. The second section is located in the center of the accordion and is called the bellows. And finally, the third section on the left side is called the bass. In addition, all accordions have a bass strap on the bass side. The bass strap is attached to the back panel of the accordion at the top, and is also attached to the back panel at the bottom.

The accordion is an acoustic portable musical instrument, and because of its portability it is very popular and it is accepted word-wide in its field. The accordion family contains many different types with names such as concertina, cordovox, button box, etc. Their tuning may vary from major, minor, chromatic, arabic, etc. In 1989 the digital accordion (also referred to as MIDI) was introduced and referred to in U.S. Pat. No. 4,884,488 issued to Giorgio F. Curetto on Dec. 5, 1989.

On Nov. 1, 1938, U.S. Pat. No. 2,134,854 was issued to John M. Bolster. On Jan. 23, 1940, U.S. Pat. No. 2,187,809 was issued to Salvatore Rabuazzo. These patents pertain to the bass section of the accordion and specifically to the left hand belt system.

Professional musicians, with many years experience playing the accordion, always felt trapped or restricted while playing accordions using the prior known bass strap or belt. The prior known accordion bass belt is attached to the bass back panel of the accordion on the top and is attached on the bottom. This creates a wedge shape condition that when the left hand is in the center of the belt and the belt is tightened, the hand and the fingers are cramped. When the hand is moved up or down it is trapped in the narrowing wedge of the belt. It is very difficult to play the upper or lower bass and chord buttons with any accuracy, or speed using this prior known belt system. Another bothersome problem is that the screw type tighter constantly needs to be adjusted because of the expansion of the strap that is caused by the weight of the accordion and the stretching of the strap itself. This prior art system is clumsy and makes it virtually impossible to play the accordion bass at its best. The prior belt system is also very expensive to manufacture and costly to install on the accordion. This system can cause the leer hand to be inaccurate and causes longer reaction time to respond in tempo with the right hand. The acoustic, as well as the MIDI accordion, is a beautiful complex musical instrument that is completely portable. However, the prior belt system which has created the present left hand environment, by strapping and positioning of the left hand, in a wedge configuration which makes it awkward to play the bass section efficiently. This awkward design directly affects by hindering the left hand's freedom of movement, and the ability to press all bass and chord buttons accurately. Through the years it has been a prolonging problem and until this invention, has never been solved.

The present invention is specifically directed to the left hand strap and how it effects the degree of manipulation of the left hand bass and chord buttons. The new harness of this invention grips the hand in a way that makes allowances for hand sizes and it allows for differing arm lengths. The prior belt system is not completely adjustable and this can not be adjusted to varying hand and arm sizes. Likewise the prior system is not capable of adjusting to firmly hold the left hand when it continuously moves in and out and up and down. Further, the left hand strap of the prior system has to be frequently re-tightened.

In summary, the prior known accordion bass strap device is actually a detriment to new students of music. They will never learn to play the bass section fluently, because of this faulty and awkward system. The present invention, however, overcomes all the problems of the prior art system and provides an efficient system to enhance accordion playing.

SUMMARY OF THE INVENTION

This invention replaces the prior belt system universally found on almost all accordions. The present invention provides a bass sliding mechanism that overcomes many of the problems associated with the wedge type configuration of the prior belt system.

A further object of the invention is to allow the left hand of the accordion player to support the bass side of the accordion, yet move freely up and down to play all the bass and cord buttons easily.

Yet another object of this invention is to provide a sliding bass mechanism that is easily installed and can fit all types of accordion.

Still another object is to provide a sliding bass mechanism that allows less experienced accordion players to play the bass section efficiently and fluently.

These and other objects are achieved by providing an accordion sliding bass mechanism comprising, in combination, a stationary back plate; a slide plate slidably engaged with the back plate; and a wrist harness attached to the slide plate.

DESCRIPTION OF A PREFERRED EMBODIMENT

Figure 1:
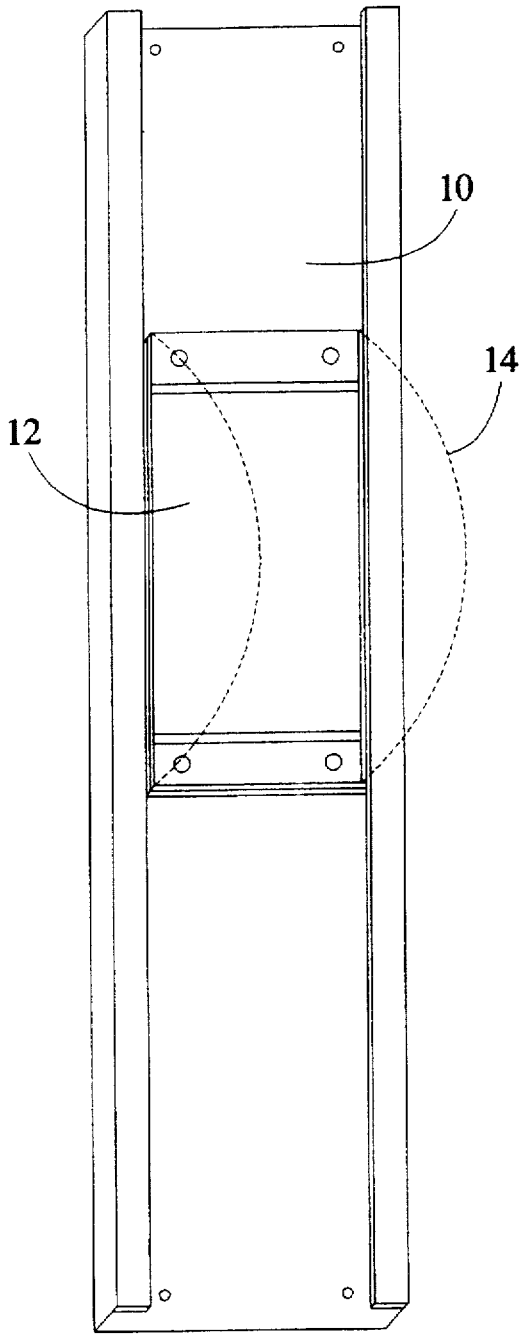
FIG. 1 shows the stationary back plate of the accordion with the sliding bass plate attached.

The accordion sliding bass of this invention is comprised of two basic elements. In FIG. 1 one of these elements is shown as a back plate 10. The other element, slide plate 12, is illustrated in FIG. 2A FIG. 2B, FIG. 3, and FIG. 4, together in combination.

Referring to FIG. 1, the stationary back plate 10 is attached to the bass back panel of the accordion. This attachment is preferably made permanent with the use of rivets or screws. Back plate 10 can be made of metal, plastic, hardwood or other durable and rigid material, preferably it is machined from hardened polished aluminum. Back plate 10 is formed into a shape to accept a movable slide plate 12.

Preferably back plate 10 is fabricated with raised channels disposed on either side of the back plate. These channels slidably engage the slide plate 12. The slide plate may or may not be fabricated of the same material as the back plate. FIG. 1 also shows the sliding bass mechanism having attached a wrist harness 14 as illustrated by the fathom lines. The height or length of the back plate is long enough such that an average size left hand engaging the slide plate 12 can reach all of the buttons on the bass portion of the accordion. Because on most accordions the bass back panel is a minimum of 8 inches high and a maximum of 16 inches, the back plate 10 can easily be manufactured to a single size. The advantage of having a single size for the back plate is that any lay person can easily retrofit an existing accordion with the sliding bass mechanism of this invention. In the event the accordion length is shorter than the back plate, the back plate can be easily cut to size with a hack saw before installation.

Figure 2A:
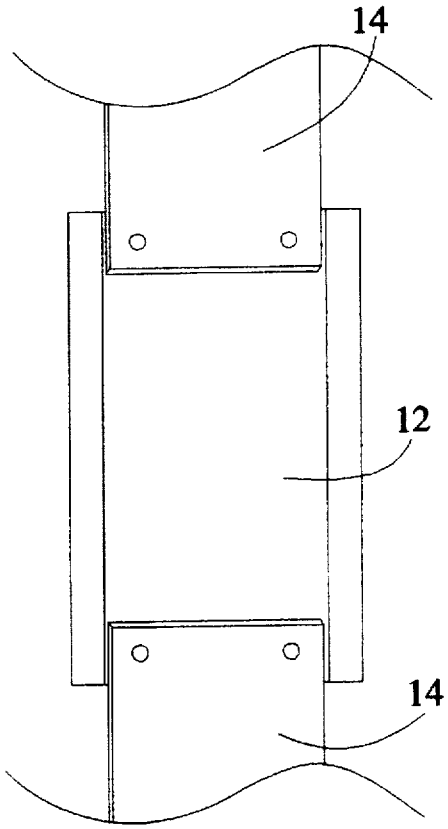
FIG. 2A shows the sliding bass plate with both ends of the wrist harness having self stick fabric attached.
Figure 2B:
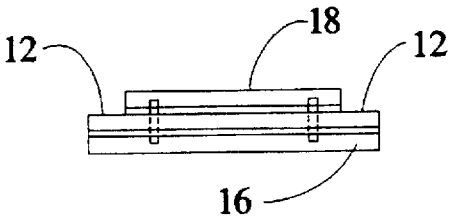
FIG. 2B shows an end view of FIG. 2A with foam pad covered wrist rest installed.

FIG. 2A shows the slide bass plate 12 in more detail, with both ends having a wrist harness 14 in place, but not yet permanently attached to the slide plate. Wrist harness 14 can be made of any material that comfortably cooperates with the wrist of the lea hand, for example, leather, nylon or other soft synthetic material. Preferably the wrist harness 14 is completely adjustable, so that the wrist is held in a snug position. This is best accomplished using hook and loop fastener material, such as Velcro®. FIG. 2B is an end view of the completed sliding bass mechanism, absent the wrist harness 14. FIG. 2B shows the slide bass plate 12, optional wrist pillow 18, and optional compression sleeve 16. Compression sleeves 16 are used to insure that the slide plate moves freely and smoothly along the back plate. When the back plate has channels, a compression sleeve can be attached to at least one edge of the slide plate to engage the channel walls. The optional compression sleeves can be fabricated from any material that improves the slidability of the slide plate. For example, the compression sleeve can be made of plastic, soft metal or Teflon®.

Figure 3:
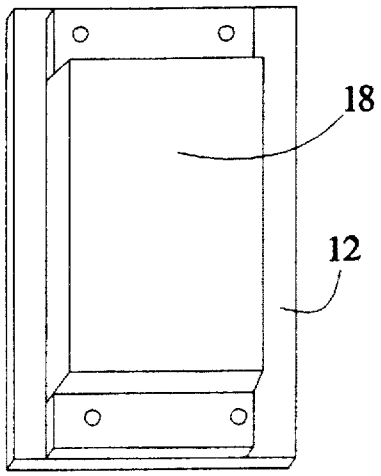
FIG. 3 shows the sliding bass plate with the foam pillow wrist rest.

FIG. 3 illustrates the location of the optional wrist rest pillow 18. The pillow can be any soft cushy material that provides a comfortable rest for the wrist of the left hand. Preferably the wrist rest pillow is a foam cushion covered with a fabric to form a comfortable resting place for the left wrist and hand. The wrist pillow 18 is attached to the slide bass plate 12.

Figure 4:
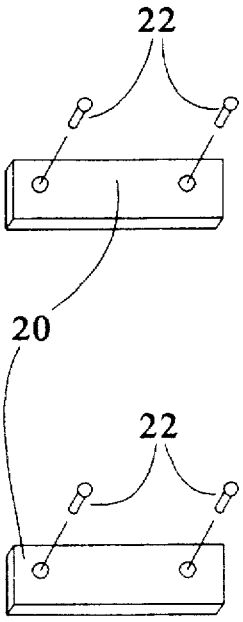
FIG. 4 shows two aluminum fasteners.

FIG. 4 shows two fastener plates 20 that are used to hold the wrist pillow 18 and wrist harness 14 in place on the slide plate. Fastener plates 20 can be machined from any durable and rigid material, such as metal, hard wood, or plastic. Preferably, hardened polished aluminum is used to construct the fastener plates 20. The fastener plates are secured to the slide plate 12 using any fastener that provides a secure attachment, such as a rivet, screw, spot weld, epoxy or glue. Aluminum pop rivets are the preferred attachment means.

Figure 5:
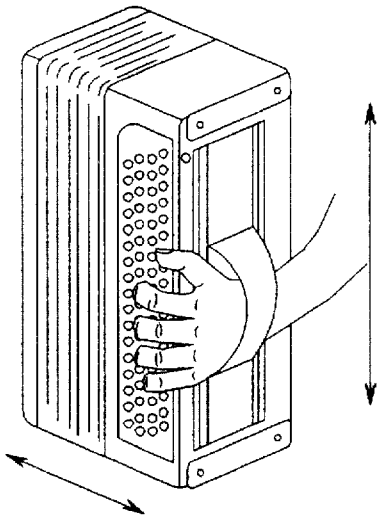
FIG. 5 shows a perspective view of all components of the accordion sliding bass in place.

FIG. 5 is a perspective view of an accordion with the sliding bass mechanism of this invention attached to the bass side (the right treble side is not shown); the arrows denote the direction the hand, wrist and arm follow during play of the accordion. As the hand moves up and down, the slide plate 12 and wrist harness 14 move in a like manner along the length of the back plate 10. This allows the fingers of the left hand to reach all of the bass and chord buttons easily. The in and out direction causes the bellows of the accordion to open and close. The thumb and palm of the left hand will act as the stopper when rapid up and down motions are made.

While for purposes of illustration, the present invention has been described with references to the particular embodiments described herein. It will be apparent to those skilled in the art that the present invention may be embodied in other specific forms without departing from the spirit or essential attributes thereof and, accordingly, reference should be made to the appended claims rather than to the foregoing specification as indicating the scope of the invention.

I claim as my invention:

1. An accordion sliding bass mechanism comprising, in combination, (a) a non-movable back plate having channels disposed longitudinally along its sides wherein the back plate is of such a design and is fabricated from a material that can be cut to size for securely fitting it to an accordion;

(b) a slide plate having compression sleeves mounted on each side of the slide plate to slidably engage each channel on the back plate where said compression sleeve is fabricated from a synthetic material;

(c) an adjustable wrist harness attached to said slide plate; and (d) a foam covered wrist rest pillow attached to said slide plate.

* * * * *

UNITED STATES PATENT AND TRADEMARK OFFICE

CERTIFICATE OF CORRECTION

PATENT NO. : 5,731,532
DATED : Mar. 24, 1998
INVENTOR(S) : Joseph J. Slaby

It is certified that error appears in the above-indentified patent and that said Letters Patent is hereby corrected as shown below:

Column 1, line 52, "leer" should read –left—

Column 3, line 23, "lea" should read –left--

Signed and Sealed this

Twenty-seventh Day of October, 1998

*Attest:*

Bruce Lehman

BRUCE LEHMAN

*Attesting Officer*

*Commissioner of Patents and Trademarks*